US011718951B2

(12) United States Patent
Maiani

(10) Patent No.: US 11,718,951 B2
(45) Date of Patent: Aug. 8, 2023

(54) COMPOSITIONS FOR OXIDIZING GARMENTS AND RELATED METHODS

(71) Applicant: KEMIN INDUSTRIES, INC., Des Moines, IA (US)

(72) Inventor: Giovanni Maiani, Riccione (IT)

(73) Assignee: KEMIN INDUSTRIES, INC., Des Moines, IA (US)

( * ) Notice: Subject to any disclaimer, the term of this patent is extended or adjusted under 35 U.S.C. 154(b) by 0 days.

(21) Appl. No.: 16/920,513

(22) Filed: Jul. 3, 2020

(65) Prior Publication Data

US 2021/0002815 A1 Jan. 7, 2021

Related U.S. Application Data

(60) Provisional application No. 62/870,223, filed on Jul. 3, 2019.

(51) Int. Cl.

| | |
|---|---|
| ***D06L 4/13*** | (2017.01) |
| ***D06P 5/13*** | (2006.01) |
| ***D06L 4/70*** | (2017.01) |
| ***D06P 1/22*** | (2006.01) |

(52) U.S. Cl.

CPC ..... *D06L 4/13* (2017.01); *D06L 4/70* (2017.01); *D06P 1/228* (2013.01); *D06P 5/132* (2013.01)

(58) Field of Classification Search

CPC ... D06L 4/13; D06L 4/70; D06P 1/228; D06P 5/132

See application file for complete search history.

(56) References Cited

U.S. PATENT DOCUMENTS

| | | | | |
|---|---|---|---|---|
| 5,205,835 | A * | 4/1993 | Tieckelmann | D06P 5/132 8/101 |
| 5,261,925 | A * | 11/1993 | Wasinger | D06B 11/0096 8/101 |
| 5,633,722 | A * | 5/1997 | Wasinger | G01J 3/50 250/226 |
| 6,537,327 | B2 | 3/2003 | Rodrigues | |
| 10,051,905 | B2 | 8/2018 | Benefiel et al. | |
| 2014/0007356 | A1 * | 1/2014 | Kunnure | D06P 5/158 8/401 |

OTHER PUBLICATIONS

International Searching Authority, "Search Report and Written Opinion," issued in connection with International Patent Application No. PCT/US2020/040805, dated Oct. 8, 2020, 21 pages.

DeLaude et al., "A Novel of Oxidizing Reagent Based on Potassium Ferrate (VI)," Journal of Organic Chemistry, vol. 61, No. 18, 1996, pp. 6360-3670.

* cited by examiner

*Primary Examiner* — Amina S Khan

(74) *Attorney, Agent, or Firm* — Nyemaster Goode P.C.

(57) ABSTRACT

The present invention relates generally to compositions and methods for oxidizing or discoloring garments, such as denim. Another aspect relates to providing a cost-effective and environmentally safe alternative to hazardous bleaching agents, such as potassium permanganate.

21 Claims, 11 Drawing Sheets

| | POTASSIUM PERMANGANATE | POTASSIUM FERRATE (VI) | SODIUM PERSULFATE + UREA |
|---|---|---|---|
| Formula, CAS# | $KMnO_4$ 7722-64-7 | $K_2FeO_4$ 13718-66-6; 39469-86-8 | |
| Notified classification and labelling according to CLP criteria. Pictograms. (ECHA) | 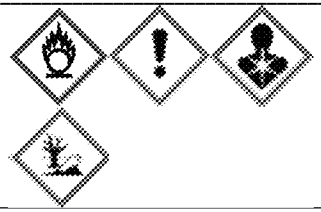 | 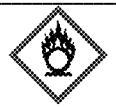 | 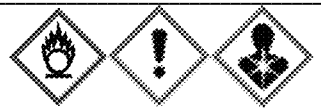 Pictograms refer to sodium persulfate |
| Hazard Statement Code (s) (ECHA) | H272 - May intensify fire; oxidizer<br>H302 - harmful if swallowed<br>H400 – very toxic to aquatic life<br>H410 - very toxic to aquatic life with long lasting effects.<br>H361d - suspected of damaging the unborn child in contact with skin. | H272 - May intensify fire; oxidizer | H272 - May intensify fire; oxidizer<br>H319 – Causes serious eye irritation<br>H315 - Causes skin irritation<br>H317 - May cause an allergic skin reaction<br>H334 - May cause allergy or asthma symptoms or breathing difficulties if inhaled<br>H335 - May cause respiratory irritation |
| Color of solution (4% w/w) | Very dark, violet | Very dark, violet-purple (hardly distinguishable from $KMnO_4$ solutions in concentrations above 1% w/w). | Transparent (15% Sodium Persulfate, 35% Urea) |

FIG. 8

| | POTASSIUM PERMANGANATE | POTASSIUM FERRATE (VI) | POTASSIUM PERSULFATE + UREA |
|---|---|---|---|
| | 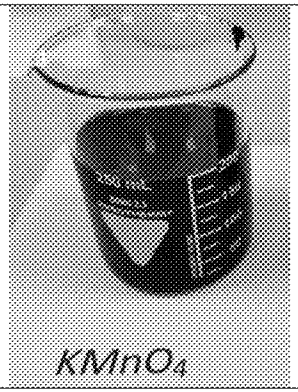  | 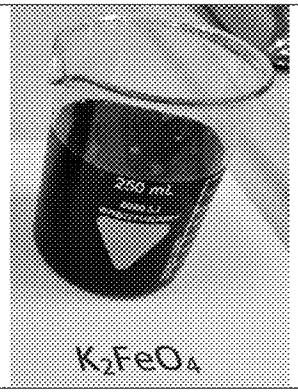  | |
| Color of indigo-dyed denim after application of concentrated solutions of oxidizers. | Sprayed areas turn brown. | Sprayed areas turn brown. | None |
| Applicable by spray on garments | YES | YES | YES |
| Bleaching of denim requires heating (ovens) | NO | NO | YES (60<T<90°C) |
| Productivity issues | NO | NO | YES (activation in ovens requires time and additional handling costs) |
| Special training needed | NO (it is the standard application) | NO<br>- Usually, operators are unable to distinguish solutions of $KMnO_4$ from solutions of $K_2FeO_4$, even after they are applied on denim.<br>- Operators can continue to rely on brownish color of fabric to visualize where solutions are applied. | YES<br>- Particular care should be adopted to avoid excessive strength loss of fabric due to overdosages or excessive thermal stress.<br>- Particular skills must be adopted to understand where the oxidizer are applied. |

FIG. 8 (cont.)

COMPOSITIONS FOR OXIDIZING GARMENTS AND RELATED METHODS

CROSS-REFERENCE TO RELATED APPLICATIONS

This application claims the benefit of priority to U.S. Provisional Patent Application No. 62/870,223, filed Jul. 3, 2019, entitled "COMPOSITIONS FOR OXIDIZING GARMENTS AND RELATED METHODS," the disclosure of which is hereby incorporate by reference in its entirety.

BACKGROUND OF THE INVENTION

Potassium permanganate ($KMnO_4$, CAS #7722-64-7) is a powerful oxidizing agent, and is widely used in the denim industry to perform localized discolorations and to accentuate worn looks on garments. Generally speaking, applications of potassium permanganate ($KMnO_4$) are performed by preparing aqueous solutions ranging from 1% to 4% w/w of $KMnO_4$. Once prepared, the solution of $KMnO_4$ is applied by trained personnel to indigo-dyed denim garments by mean of spraying devices. Due to the toxicity and potential hazards posed by exposure to $KMnO_4$, these spraying devices are typically integrated into the manufacturing process and require adequate ventilation and suction systems. The denim industry has adopted $KMnO_4$ as the preferred oxidizing agent for primarily economic reasons. In addition, when applied, $KMnO_4$ discolors the garment, for instance turning the blue denim to a brown color, which provides visual real-time feedback of the areas of the garment that have been treated with the oxidizer. The use of $KMnO_4$ was consolidated over the years, becoming the current industry standard for localized bleaching operations.

Other methodologies based on different oxidizers, such as sodium hypochlorite, have not been as widely-accepted by the denim industry mainly because, unlike $KMnO_4$, the alternatives did not enable clear visualization of the areas of the fabric that have been oxidized. In other words, those alternatives do not immediately discolor the garment, so it isn't readily apparent which portions of the fabric had received the solution. This could lead to uneven application or over-dosage leading to damaged fabric, or batch-to-batch inconsistencies.

Despite the economic incentives to use the modestly priced potassium permanganate as an oxidizing agent, potassium permanganate poses significant eco-toxicological concerns. Indeed, according to the Harmonised Classification and Labelling for Hazardous Substances (ATP13) published by the European Union, potassium permanganate has been deemed very toxic to aquatic life, with long lasting effects. Additionally, the classification provided by companies to European Chemicals Agency (ECHA) in Registration, Evaluation, Authorisation and Restriction of Chemicals (REACH) Regulations identifies that potassium permanganate is suspected of damaging fertility or the unborn child and may cause damage to organs through prolonged or repeated exposure.

Recently, under the pressure of various non-governmental organizations, major brands of the denim industry have been searching for alternatives to potassium permanganate. By way of example, industry leaders such as Levi Strauss & Co., have publicly declared that they will no longer develop products obtained with sprayed potassium permanganate. For instance, Levi Strauss & Co stated that its goal is to phase out and totally eliminate the use of potassium permanganate. Levi Strauss, Progress on Commitment to Zero Discharge of Hazardous Chemicals (April 2018), available at https://www.levistrauss.com/wp-content/uploads/2019/03/ZDHC-Progress-Update-2018-1.pdf.

In response to this growing demand, various specialty chemical manufacturers have proposed alternatives to $KMnO_4$, attempting to gain market share and improve the overall public perception of the industry, in terms of innovation and eco-sustainability. Most of the new proposed systems have been based on solutions of persulfates blended with urea or other activators. However, these solutions require the garments to be treated in special ovens (T=>65° C.) in order to obtain intense bleaches. Moreover, the sprayed solutions are less desirable, where the application of the oxidizer is not clearly visible on garments during the bleaching process. The inability to visualize the application can often translate into over-dosage and result in fabric damage or waste.

By way of example, there is a commercially available product that contains cerium sulfate, which in several circumstances can be used as a substitute for $KMnO_4$ as a localized bleach on denim garments. However, in order to obtain sufficient bleaching, the product must be sprayed in its pure form without any dilution, or with the addition of sodium persulfate. While the product is effective, the resulting cost per treatment of a single garment poses a barrier to many customers, and has limited the wide-scale acceptance of that product.

Another drawback related to the use of common alternatives to potassium permanganate is represented by an undesirable yellow cast exhibited by indigo-dyed denim fabrics after bleaching treatment. The yellow cast is particularly intense if cerium sulfate or sodium persulfate activated by urea is used as a bleaching agent. Despite the pressures exercised by non-governmental organizations and denim brands, $KMnO_4$ continues to be the most used agent for discolorations in the denim industry.

Accordingly, there remains a long-felt need for a cost-effective and environmentally safe alternative to potassium permanganate that will meet the criteria for a discoloration agent required by the denim industry, but without the hazardous profile of potassium permanganate.

SUMMARY OF THE INVENTION

The present invention relates generally to compositions and methods for oxidizing or discoloring garments, such as denim. Another aspect relates to providing a cost-effective and environmentally safe alternative to hazardous bleaching agents, such as potassium permanganate.

DETAILED DESCRIPTION OF THE FIGURES

The patent or application file contains at least one drawing executed in color. Copies of this patent or patent application publication with color drawing(s) will be provided by the Office upon request and payment of the necessary fee.

FIG. 1 depicts bleaching, expressed in lightness variations (DL*), obtained at different concentrations of oxidizing solutions using de-sized fabric as the reference. DL* values are the average of triplicates. Error bars are the standard deviation.

FIG. 2 depicts yellowing, expressed in blueness-yellowness variations (Db*), obtained at different concentrations of oxidizing solutions using de-sized fabric as the reference. Db* values are the average of triplicates. Error bars are the standard deviation.

FIG. 8 compares the characteristics of common oxidizers used for denim bleaching including hazards or risk associated with each oxidizer.

Figure 9:
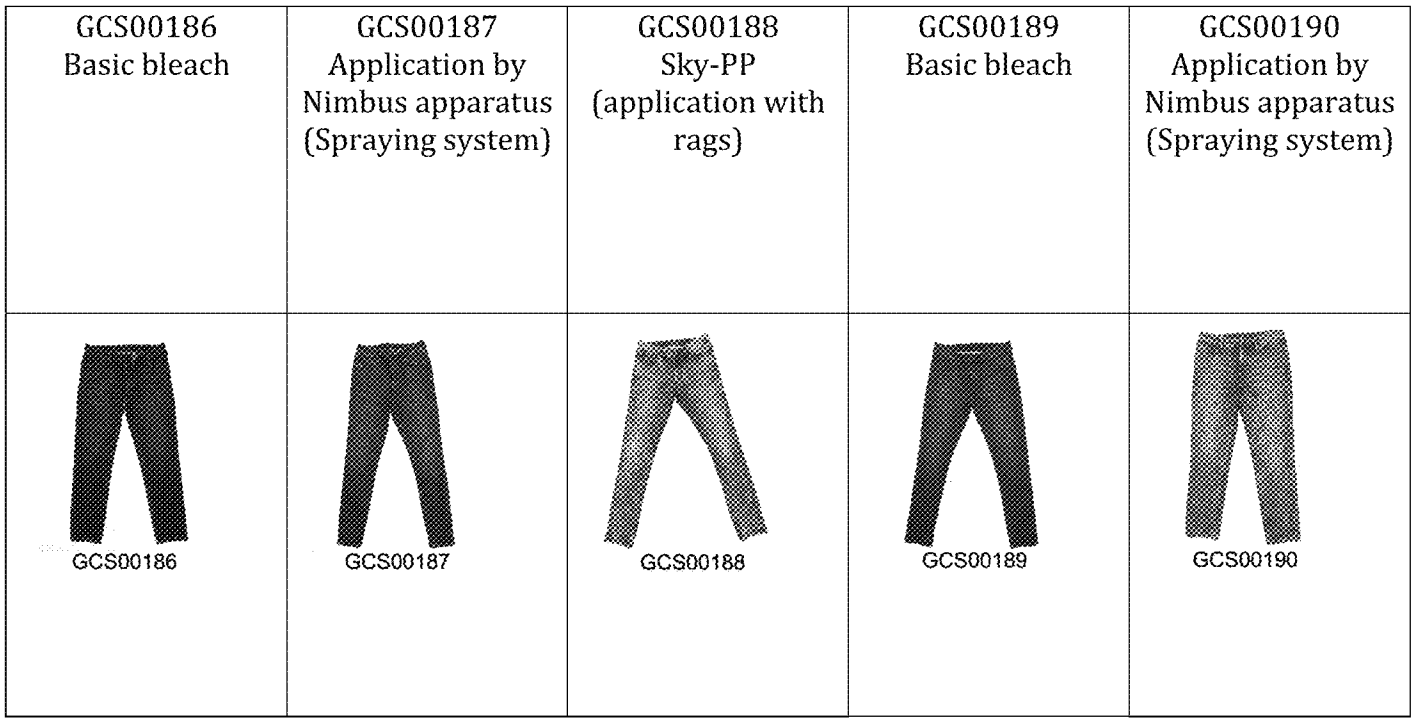

FIG. 9 depicts industrial treatments performed using 20 to 60 g/L of k $K_2FeO_4$.

Figure 10:
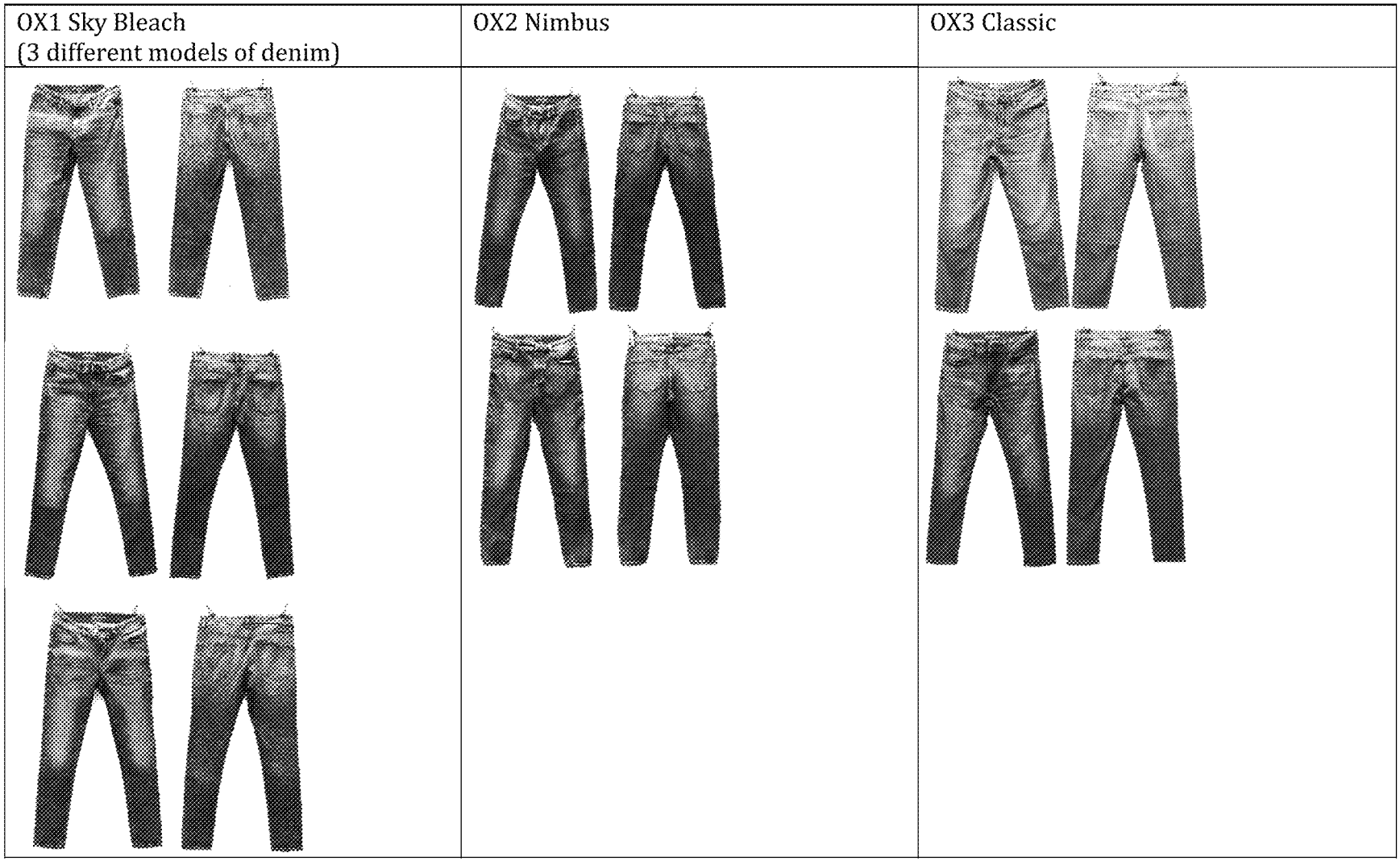

FIG. 10 depicts Industrial treatments performed using 20 to 60 g/L of $K_2FeO_4$.

DETAILED DESCRIPTION OF THE INVENTION

The present invention relates generally to novel compositions containing potassium ferrate (VI) ($K_2FeO_4$, CAS #39469-86-8, 13718-66-6) and methods using these compositions as an oxidizing agent for localized discoloration on garments, such as denim. The present invention has numerous benefits over the widely-used options for bleaching denim, such as potassium permanganate, which has been deemed hazardous and poses significant health and environmental risks.

According to at least one embodiment, the present invention contains potassium ferrate (VI). According to at least one embodiment, the present invention is in a powder-form until it is ready to be used. According to at least one embodiment, the present invention is applied after the application of other chemicals on the fabric. In another embodiment, the present invention is mixed into an aqueous solution prior to application on the garment.

EXAMPLES

Example 1

Materials and Methods:

Table 1 contains the materials used throughout the experiment.

TABLE 1

Materials used.

| Material | Supplier | Model | Lot# |
|---|---|---|---|
| Potassium Ferrate (VI) 91% | Ningbo Hongda Chemicals Industrial Co.,Ltd, China | — | HD191104 |
| Potassium Permanganate 97% | Sigma-Aldrich, USA | — | MKBW1544V |
| Potassium Hydroxide | Ercros, Spain | — | 180609B010 |
| Hydroxylamine Sulfate | BASF, Germany | — | 79115806D0 |
| Oxalic Acid | Brenntag, Italy | — | 2018L1005589 |
| Fortres GSL | Kemin Textiles s.r.l., San Marino | — | 1901117000 |
| DW16 L | Kemin Textiles s.r.l., San Marino | — | 1902113157 |
| Denim Fabric | Candiani, Italy | RR7716 Elast. Color: sioux - Finish: crispy | 84579D08 |
| Spectrophotometer | Datacolor, Switzerland | Datacolor 550 | — |
| Air-cooled IR dyeing unit | Datacolor, Switzerland | Ahiba IR ® | — |
| Beakers 1000 ml for Ahiba | Datacolor, Switzerland | — | — |
| Beakers 300 ml for Ahiba | Datacolor, Switzerland | — | — |
| Lab stenter | Gavazzi, Italy | RM/1 | — |
| Analytical scale | Kern, Germany | ADB 200-4 | |

The researchers tested $K_2FeO_4$ (91% purity) as an alternative to conventional oxidizing agents. The testing was performed on a denim substrate, using the classic indigo-dyed denim fabric "Sioux Crispy" provided by the manufacturer Candiani (Italy).

Denim strips (170×15 cm) were cut along weft yarns (average weight: 91.2 grams, SD: 1.1 grams) and treated in the air-cooled infrared dyeing unit with four beakers of 1000 ml. Each beaker contained a fabric sample with 500 ml of a solution consisting of 1 g/L of DW16LT (an α-amylase based product used to remove the sizing starch) and 1 g/L of Fortres GSL (a dispersing agent used to prevent the re-deposition of indigo) to remove the sizing starch. The temperature was maintained at 50° C. for 20 minutes with a rotation speed of 50 rpm. After the de-sizing treatment, the fabric was rinsed in water at 20° C. for 2 minutes, then dried at room temperature overnight. Next, the dried de-sized fabrics (average weight: 84.1 grams, SD: 0.8 grams) were cut along warp yarns (15×10 cm).

Subsequently, the researchers conducted three different studies (Table 2). In all the studies, bleaching tests were obtained in six sequential steps (degradation of indigo dye with an oxidizing solution; rinse with water to remove the excess of metal oxides; drying; removal of metal oxides; rinse with water to remove residual of chemicals; drying in the lab stenter). In all the studies, the oxidation of indigo (Table 2, step 1) and the removal of metal oxides (Table 2, step 4) were performed using the air-cooled infrared dyeing unit (beakers of 300 ml, one fabric sample for each beaker, 28° C., 10 minutes, rotational speed of 50 rpm).

In all the tests, fabric samples were rinsed with water for 2 minutes immediately after the oxidation process (Table 2, step 2) then dried at 25° C. overnight (Table 2, step 3).

In all the studies, fabric samples were rinsed with water for 2 minutes immediately after the removal of metal oxides (Table 2, step 5), then dried at 30° C. with the lab stenter (Table 2, step 6).

TABLE 2

Steps following the desizing procedure in three different studies.

| Step sequence | Step description | 1st study | 2nd study | 3rd study |
|---|---|---|---|---|
| 1 | Oxidizing solution | $K_2FeO_4$ (10, 20, 50, 100, 150 g/L) | $K_2FeO_4$ (10, 20, 50, 100, 150 g/L) + 20 g/L NaOH 1N | $KMn0_4$ (2, 5, 10, 30 g/L) |
| 2 | Rinse with water | 2 min | 2 min | 2 min |
| 3 | Drying | 25° C., overnight | 25° C., overnight | 25° C., overnight |
| 4 | Metal oxide removal | Oxalic acid, 10 g/L | Oxalic acid, 10 g/L | Hydroxylamine sulfate, 4 g/L |
| 5 | Rinse with water | 2 min | 2 min | 2 min |
| 6 | Drying | 30° C. with lab stenter | 30° C. with lab stenter | 30° C. with lab stenter |

In the initial study, each fabric sample was treated with 100 ml of solutions of $K_2FeO_4$ at different concentrations. Iron oxides were removed from fabric samples with 200 ml of a solution of 10 g/L of oxalic acid.

In a second study, tests with potassium ferrate (VI) were repeated adding 20 g/L of KOH 1N in the oxidizing solution to maximize stability of $K_2FeO_4$ and to reduce the speed of formation of iron oxide according to the reaction $4\ K_2FeO_{4+4}\ H_2O \rightarrow 3\ O_2 + 2\ Fe_2O_3 + 8\ KOH$.

A third study was conducted to mimic the most common conditions used in the denim industry, using potassium permanganate at different concentrations (2 g/L, 5 g/L, 10 g/L, and 30 g/L). Manganese oxide were successively removed from fabric samples with 200 ml of a solution of 4 g/L of hydroxylamine sulfate.

Figure 1:
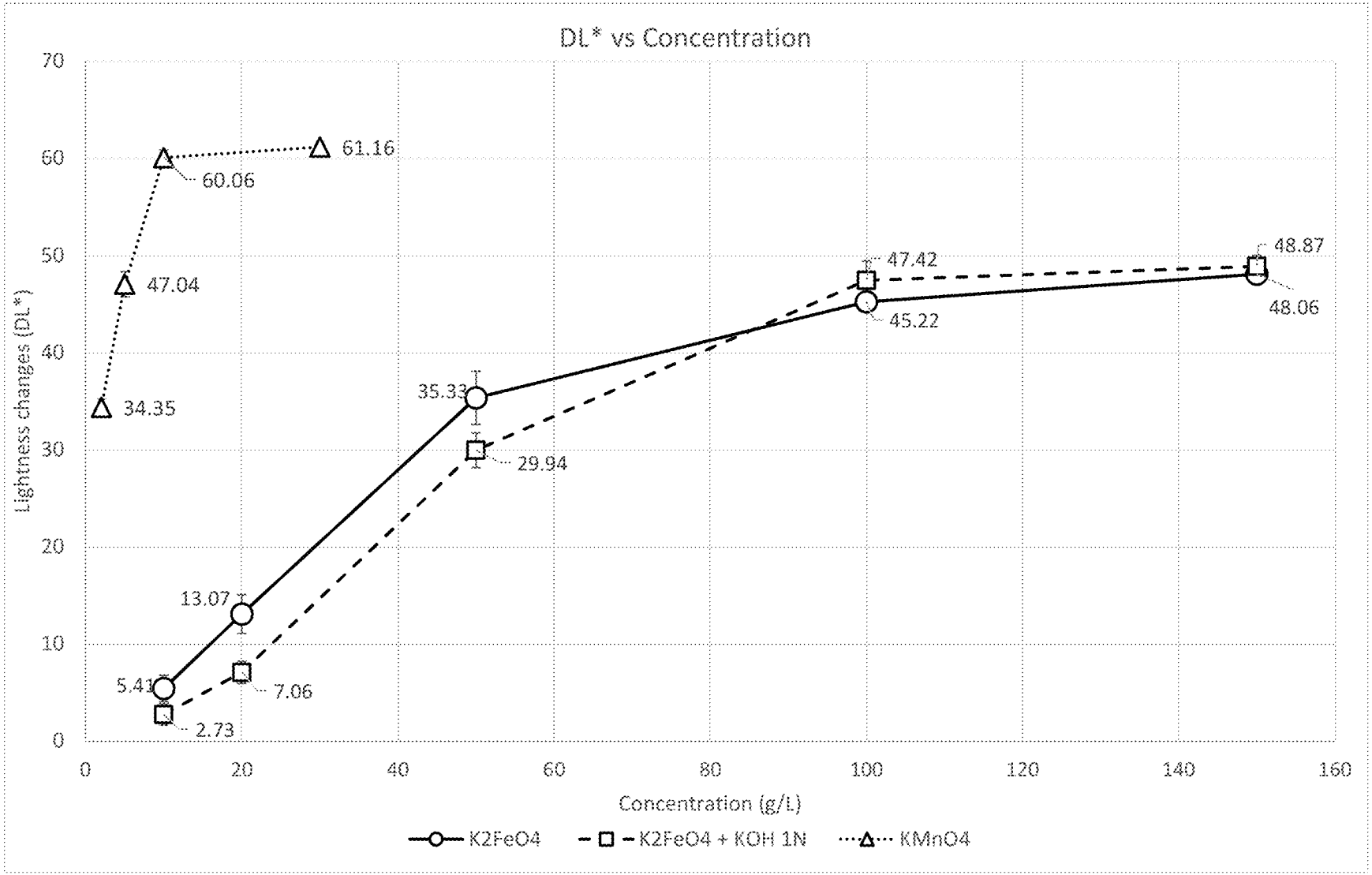
Figure 2:
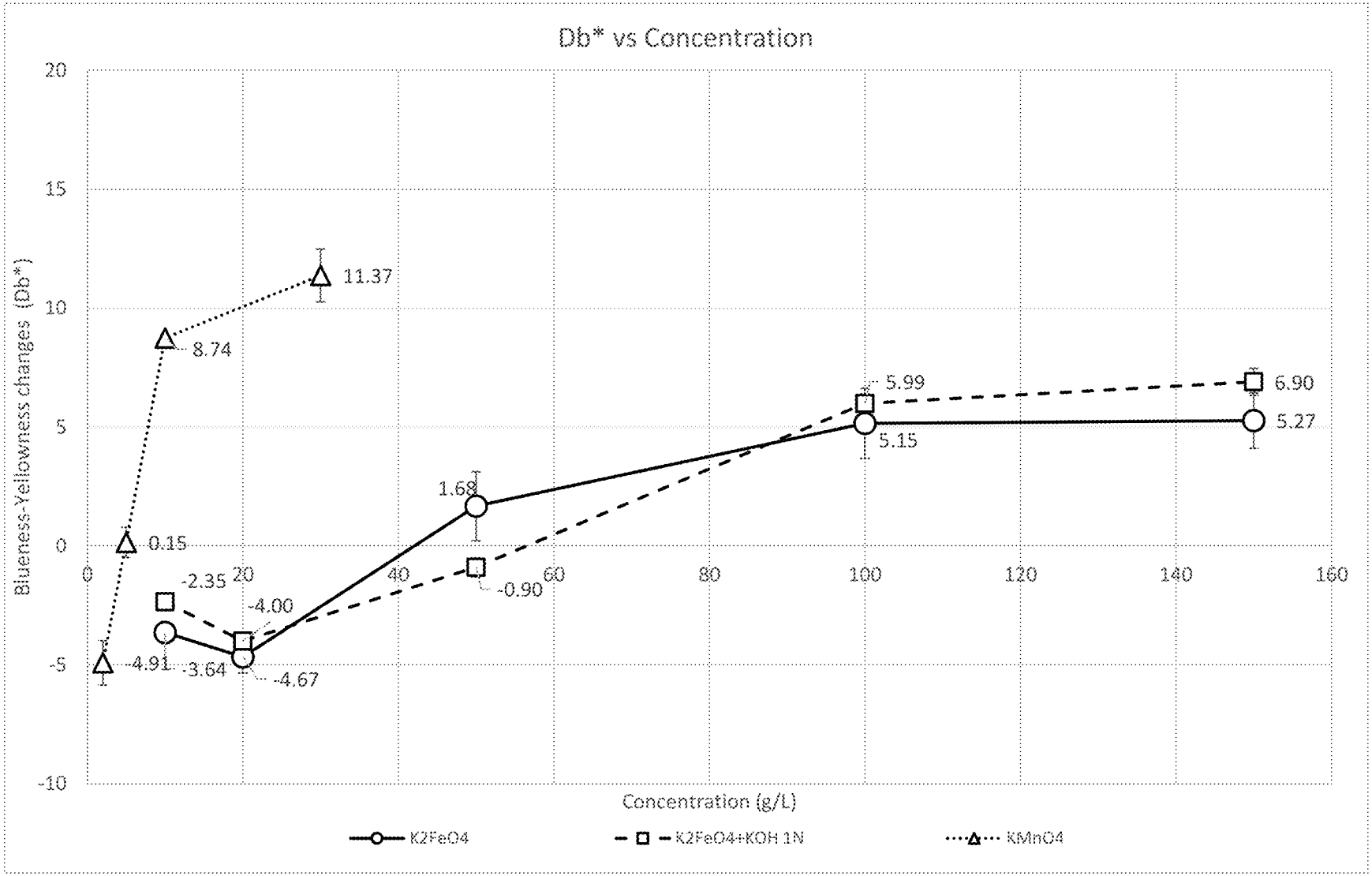
Figure 3:
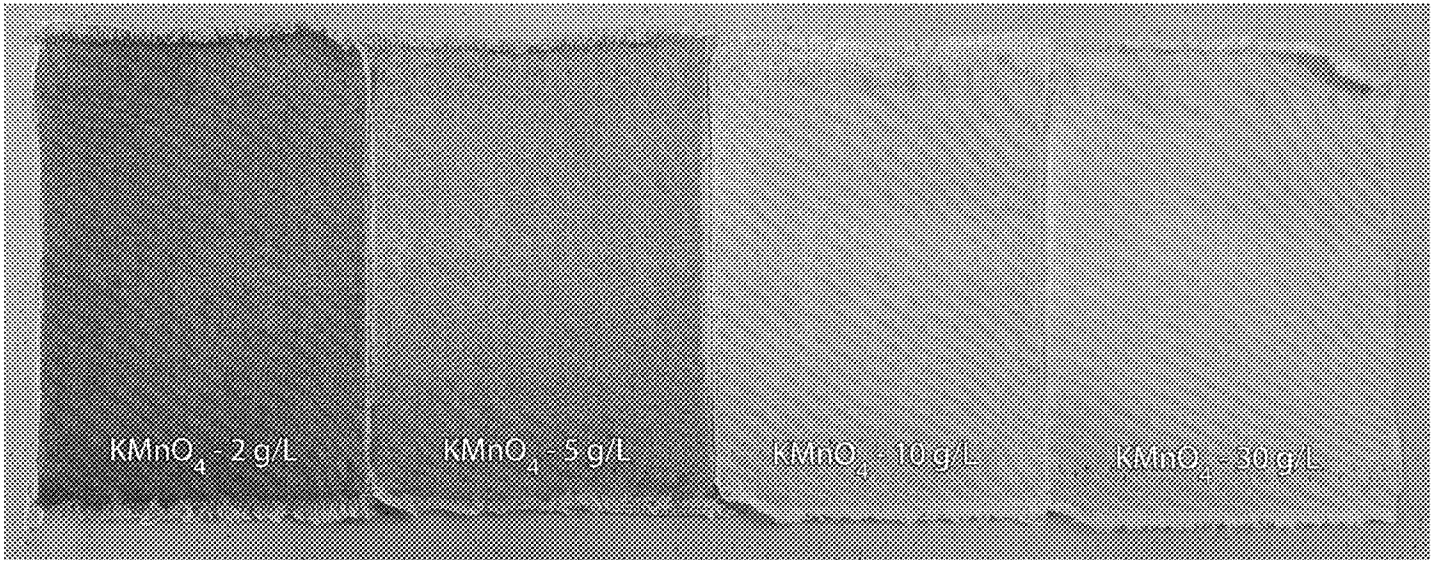
FIG. 3 depicts denim samples treated with 2 g/L, 5 g/L, 10 g/L and 30 g/L of $KMnO_4$ and subsequent removal of manganese oxides with hydroxylamine sulfate.

Results: Measurements of L* (lightness) and b* (blueness) were performed using the spectrophotometer, and results provided by solutions of $K_2FeO_4$ were compared with those offered by solutions of $KMnO_4$ at four different concentrations (2 g/L, 5 g/L, 10 g/L 30 g/L). A de-sized fabric was taken as a standard reference to calculate DL* (lightness changes) and Db* (blueness changes) as described in FIG. 1, FIG. 2, and Table 3.

TABLE 3

DL* and Db* measurements for different bleaching solutions.

| Oxidizing solution | DL* (lightness variations) | Db* (blueness variations) |
|---|---|---|
| First study ($K_2FeO_4$) | | |
| $K_2FeO_4$ (10 g/L) | 5.41 | −3.64 |
| $K_2FeO_4$ (20 g/L) | 13.07 | −4.67 |
| $K_2FeO_4$ (50 g/L) | 35.33 | 1.68 |
| $K_2FeO_4$ (100 g/L) | 45.22 | 5.15 |
| $K_2FeO_4$ (150 g/L) | 48.06 | 5.27 |
| Second study ($K_2FeO_4$ + KOH 1N) | | |
| $K_2FeO_4$ (10 g/L) + KOH 1N (20 g/L) | 2.73 | −2.35 |
| $K_2FeO_4$ (20 g/L) + KOH 1N (20 g/L) | 7.06 | −4.00 |
| $K_2FeO_4$ (50 g/L) + KOH 1N (20 g/L) | 29.94 | −0.90 |
| $K_2FeO_4$ (100 g/L) + KOH 1N (20 g/L) | 47.42 | 5.99 |
| $K_2FeO_4$ (150 g/L) + KOH 1N (20 g/L) | 48.87 | 6.90 |
| Third study ($KMnO_4$) | | |
| $KMnO_4$ (2 g/L) | 34.35 | −4.91 |
| $KMnO_4$ (5 g/L) | 47.04 | 0.15 |
| $KMnO_4$ (10 g/L) | 60.06 | 8.74 |
| $KMnO_4$ (30 g/L) | 61.16 | 11.37 |

Figure 4:
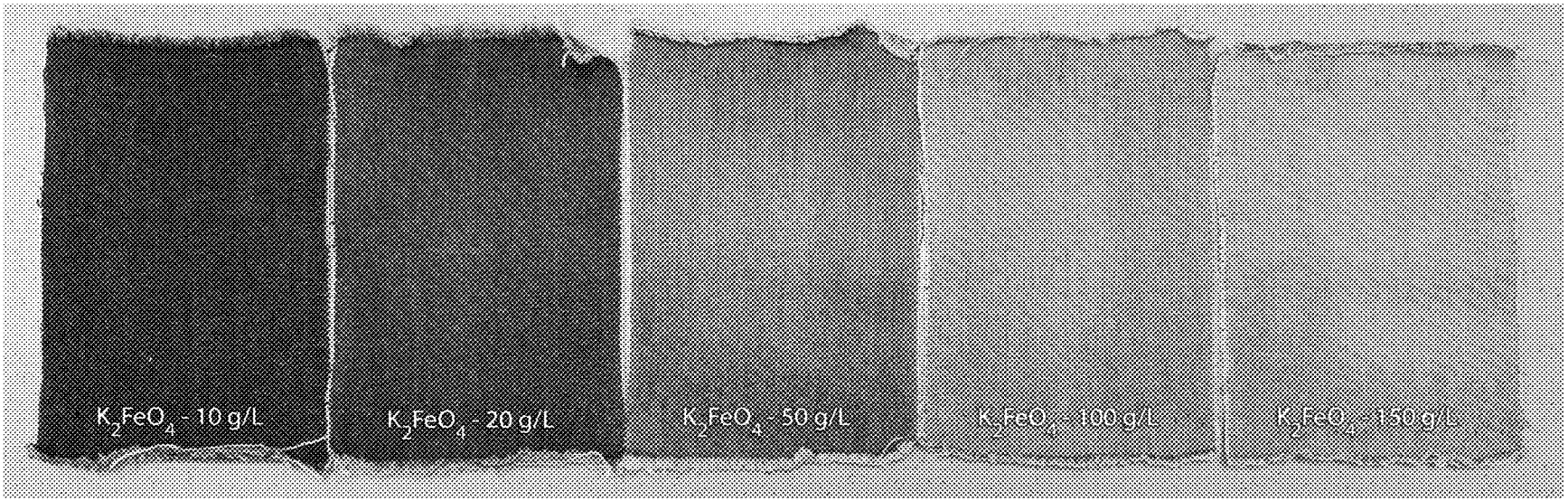
FIG. 4 depicts samples of denim fabric treated with different concentrations of potassium ferrate (VI) and subsequent removal of iron oxides with oxalic acid.

Potassium permanganate used with the typical concentrations adopted in the denim industry (10 to 30 g/L) can perform stronger and faster degradation of indigo compared to potassium ferrate (VI). However, potassium ferrate (VI) allows for control of the bleach intensity (FIG. 4). The original blueness of the denim is preserved and Db* values for intense discolorations were comparable to those exhibited by potassium permanganate.

Figure 5:
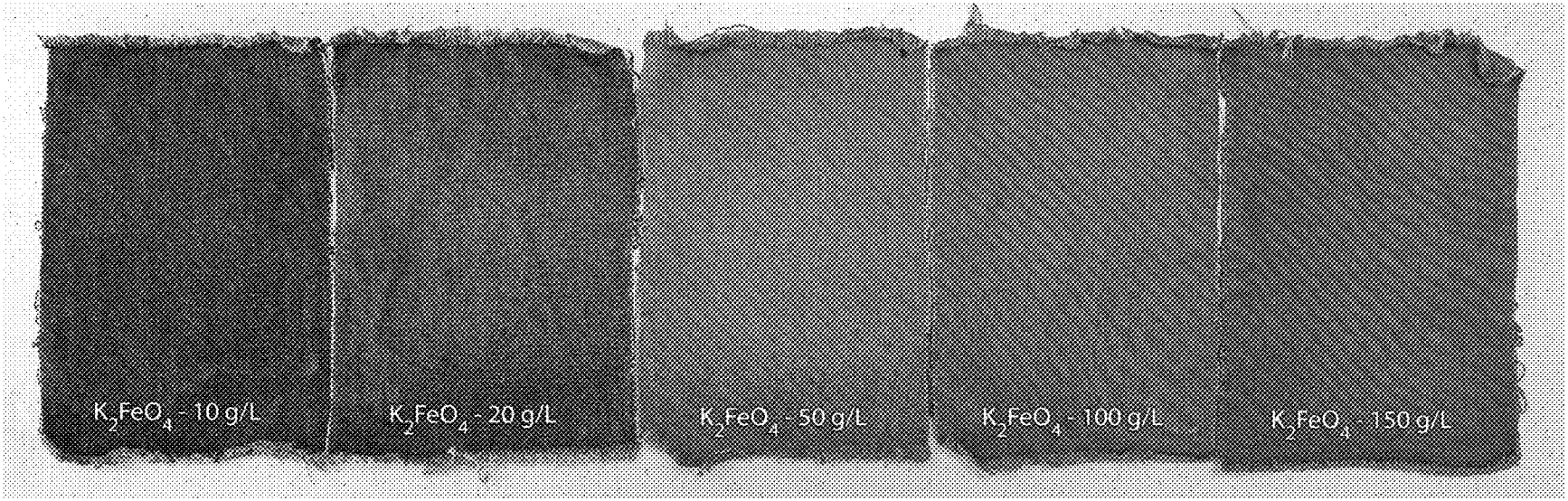
FIG. 5 depicts fabric samples immediately after treatment with solutions of $K_2FeO_4$ (increasing concentrations from left to right), before the removal of iron oxides with oxalic acid.
Figure 6:
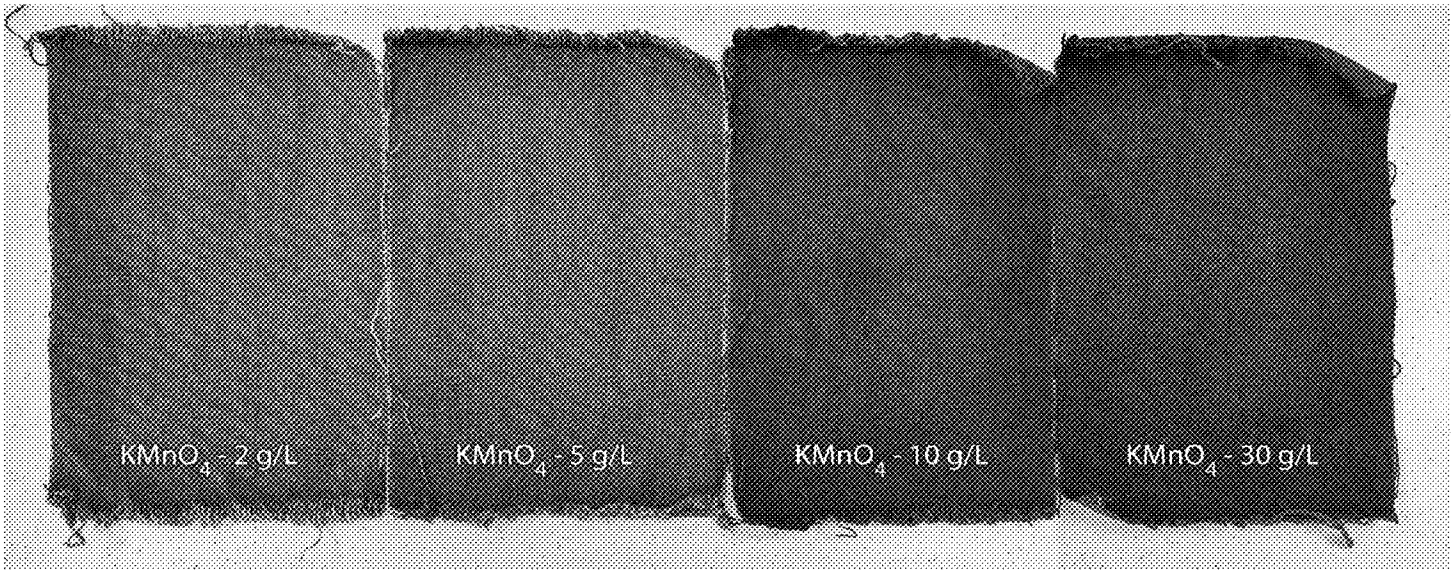
FIG. 6 depicts fabric samples immediately after treatment with solutions of $KMnO_4$ (increasing concentrations from left to right), before the removal of manganese oxides with hydroxylamine sulfate.

A great advantage of using potassium ferrate (VI) is the instantaneous visual feedback of the areas of denim treated with $K_2FeO_4$ (FIG. 5). The denim quickly acquires an intense brown shade due to the presence of iron oxides on the fabric, mimicking the visual effect produced by $MnO_2$ after the application of $KMnO_4$ solutions (FIG. 6).

Example 2

Materials and Methods:
Table 4 contains the materials used throughout the experiment.

TABLE 4

Summary of materials used.

| Material | Supplier | Model | Lot # |
|---|---|---|---|
| Potassium Ferrate (VI) 91% | Ningbo Hongda Chemicals Industrial Co., Ltd, China | — | HD191104 |
| Potassium Permanganate | Sigma-Aldrich, USA | — | MKBW1544V |
| Sodium Persulfate | Brenntag, Italy | — | 10000103319 |
| Hydroxylamine Sulfate | BASF, Germany | — | 79115806D0 |
| Oxalic Acid | Brenntag, Italy | — | 2018L1005589 |
| Denim Fabric | Candiani, Italy | RR7716 Elast. Color: sioux - Finish: crispy | 84579D08 |
| Air-cooled IR dyeing unit | Datacolor, Switzerland | Ahiba IR ® | — |
| Ahiba beakers 1000 ml for Ahiba IR ® | Datacolor, Switzerland | — | — |
| Spectrophotometer | Datacolor, Switzerland | Datacolor 550 | — |
| Padding equipment | Gavazzi, Italy | FL300/E | — |
| Lab stenter | Gavazzi, Italy | RM/1 | — |
| Analytical scale | Kern, Germany | ADB 200-4 | |

The researchers tested sodium persulfate ($Na_2S_2O_8$ CAS #7775-27-1) as a booster for potassium ferrate. Similarly to $K_2FeO_4$, sodium persulfate is a strong oxidizing agent that can oxidize indigo, thus causing discolorations on denim fabric. To consider sodium persulfate a booster of $K_2FeO_4$, the increase of lightness of fabric obtained with the combined use of the two substances should be significantly higher than the sum of lightness changes introduced by the same substances if they were used alone. In a first study, tests were performed on squared samples (15 cm×15 cm) of indigo-dyed denim fabric after the following treatments:

a. The fabric samples were dipped for 15 seconds in solutions having different concentrations of sodium persulfate at 20° C. Immediately after, it was performed a hydro extraction using the padding equipment. Pick-up was 90%±5%.

b. Next, the fabric samples were immersed for 15 seconds in a solution of 15% w/w of $K_2FeO_4$. The excess of the solution was removed from the fabric samples using the padding equipment. Pick-up was 90%±5%.

c. The fabric samples were dried in a Gavazzi, model RM/1, lab stenter at 35° C. for 4 hours.

d. In order to simulate the most common processes that are adopted in industrial laundries, the bleached samples were treated in an the air-cooled infrared dyeing unit for 20 minutes, at 40° C., and at 40 rpm with 500 ml of a 10 g/L solution of oxalic acid (1000 ml beakers).

e. After the treatment, the fabric samples were rinsed with water (25° C., 2 minutes) and dried at room temperature overnight.

To evaluate the contribution of potassium persulfate, a second study was conducted repeating the steps a. and c. of the first study.

Subsequently, measurements of L* (lightness) and b* (blueness) on the fabric samples were performed using the spectrophotometer. A raw untreated fabric was taken as a standard reference to calculate DL* (lightness changes) and Db* (blueness changes) as described in Table 5 and Table 6.

TABLE 5

DL* and Db* measurements on fabrics of denim pre-treated with solutions having different concentrations of $Na_2S_2O_8$ and subsequently treated with solution of 15% w/w of $K_2FeO_4$.

| Pre-treatment Conc. of $Na_2S_2O_8$ | Post treatment Conc. of $K_2FeO_4$ | DL* (lightness changes) | Db* (blueness changes) |
|---|---|---|---|
| — | 15% w/w | 10.79 | −3.66 |
| 2% w/w | 15% w/w | 18.82 | −2.90 |
| 5% w/w | 15% w/w | 21.04 | −2.82 |
| 10% w/w | 15% w/w | 25.13 | −2.17 |
| 15% w/w | 15% w/w | 26.59 | −2.25 |
| 20% w/w | 15% w/w | 26.82 | −2.32 |

TABLE 6

DL* and Db* measurements on fabrics of denim treated with solutions having different concentrations of $Na_2S_2O_8$.

| Concentration of $Na_2S_2O_8$ | DL* (lightness changes) | Db* (blueness changes) |
|---|---|---|
| 2% w/w | 0.40 | −1.56 |
| 5% w/w | 1.14 | −1.91 |
| 10% w/w | 1.90 | −3.24 |
| 15% w/w | 2.97 | −3.63 |
| 20% w/w | 3.16 | −3.68 |

Figure 7:
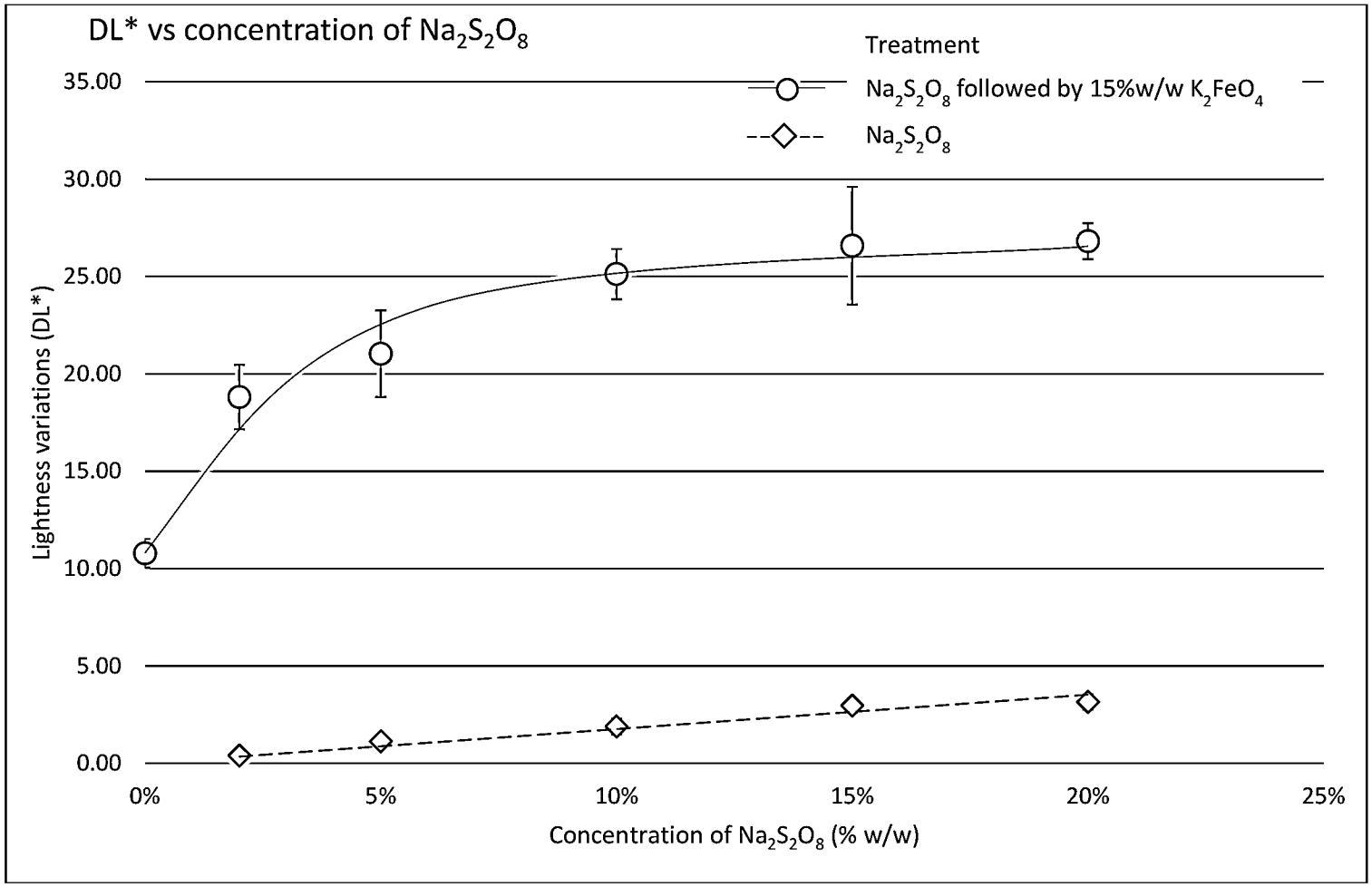
FIG. 7 depicts bleaching, expressed in lightness variations (DL*), obtained at different concentrations of $Na_2S_2O_8$, with or without post-treatment with $K_2FeO_4$ (15 w/w).

Results: Measurements of L* on denim surface revealed that a pre-treatment with solutions of $Na_2S_2O_8$ immediately before the application of solutions of $K_2FeO_4$ can significantly increase the performance of bleaching processes. Negative values of Db* shown in Table 5 confirm that treatments with solutions of $K_2FeO_4$, with or without pre-treatment with solutions of $Na_2S_2O_8$, do not affect negatively the blueness of the denim substrate. FIG. 7 and the comparison of DL* values shown in Table 5 and Table 6 indicate that $Na_2S_2O_8$ can significantly enhance performance of bleaching when used immediately before the application of $K_2FeO_4$.

Example 3

The researcher performed a series of industrial tests, which were conducted in order to evaluate the viability of conducting bleaching with potassium ferrate (VI) as a replacement for potassium permanganate. The initial set of trials involved five different industrial treatments, in which aqueous solutions of potassium permanganate are traditionally used in the denim industry. Next, the same treatments were performed using an aqueous solution of potassium ferrate (VI) as a replacement for the aqueous solution of potassium permanganate.

FIG. 9 describes the treatments performed using the following different techniques:

- Basic: the most common application which includes spraying the oxidizer solution in a localized area (for example, around the knees).
- Nimbus Z: treatment includes special spraying device connected to the washing machine. In this specific treatment, the application of the oxidizer is more uniform and is performed on multiple garments at the same time.
- Sky-PP: application where rags were previously soaked with a solution of the oxidizer. Rags were then inserted into the washing machine together with the garments to achieve a non-uniform bleached pattern.

Results: The results using the potassium ferrate as a replacement were very similar to those obtainable with potassium permanganate.

The second set of industrial tests were performed using existing recipes based on potassium permanganate. FIG. 10 describes the treatments performed adopting the different techniques.

Results: All tests performed confirmed that potassium ferrate (VI) can substitute potassium permanganate for bleaching operations performed in different treatments, on different garments, and adopting different methodologies.

Accordingly, one aspect of the present invention relates to providing an alternative to potassium permanganate for industrial bleaching operations. FIG. 8 provides a comparison of common oxidizers used in the garment industry to bleach denim, including characteristics and known hazards and risks associated with each agent.

Another benefit of the present invention relates to the ability to visualize the application on the garment, with immediate color change appearing on the fabric. In at least one embodiment, the application of the composition containing potassium ferrate changes the denim from a blue color to brown color where it has been applied. This visual change mirrors the results of denim that has been treated with potassium permanganate. Thus, transitioning from potassium permanganate to potassium ferrate would involve very little additional training of laundry personnel, and addresses the concerns expressed with existing alternatives that are commercially available today.

At least one embodiment of the present invention relates to a composition for discoloring or bleaching a garment comprising an effective amount of potassium ferrate (VI). In at least one embodiment, the potassium ferrate is present at a concentration ranging from about 10 to 150 g/L. In another embodiment, the potassium ferrate is present at a concentration of at least 10 g/L.

At least one embodiment of the present invention relates to compositions and methods for discoloring or bleaching garments, wherein the treated garments include but are not limited to denim. According to at least one embodiment, the garment is indigo-dyed denim.

Another aspect of the present invention relates to providing a composition or methods for discoloring or bleaching garments that is less toxic than potassium permanganate. Another aspect of the present invention relates to providing a composition that has characteristics that are environmentally-friendly compared to potassium permanganate. At least one embodiment of the present invention relates to a composition for discoloring or bleaching garments that does not contain potassium permanganate.

According to at least one embodiment, the garment may be optionally treated with a composition comprising sodium persulfate, which is generally understood as a booster to the process.

According to at least one embodiment, the present invention relates to a composition or method for discoloring or bleaching a garment, wherein the composition is a dry powder. In alternative embodiments, the composition may be an aqueous solution. In embodiments where the composition is a dry powder, the user may be required to add water or another liquid solution to the dry powder prior to treating the garment. According to at least one embodiment, the composition is an aqueous solution that can be sprayed onto the garment.

According to at least one embodiment, the present invention relates to providing a composition and methods for discoloring or bleaching a garment, such as indigo-dyed denim, wherein the garment may be treated to remove metal oxides prior to applying the composition to the garment.

According to at least one embodiment, the garment may be treated locally or the garment may be treated in an industrial process where numerous garments are treated simultaneously.

According to at least one embodiment, the present invention relates to a process for discoloring or bleaching a garment, such as denim, where the composition discolors or brightens the garment upon contact and wherein the user can control the process through visual inspection of the discoloration of the garment.

It should be appreciated that minor dosage and formulation modifications of the composition and the ranges expressed herein may be made and still come within the scope and spirit of the present invention.

Having described the invention with reference to particular compositions, theories of effectiveness, and the like, it will be apparent to those of skill in the art that it is not intended that the invention be limited by such illustrative embodiments or mechanisms, and that modifications can be made without departing from the scope or spirit of the invention, as defined by the appended claims. It is intended that all such obvious modifications and variations be included within the scope of the present invention as defined in the appended claims. The claims are meant to cover the claimed components and steps in any sequence which is effective to meet the objectives there intended, unless the context specifically indicates to the contrary.

The foregoing description has been presented for the purposes of illustration and description. It is not intended to be an exhaustive list or limit the invention to the precise forms disclosed. It is contemplated that other alternative processes and methods obvious to those skilled in the art are considered included in the invention. The description is merely examples of embodiments. It is understood that any other modifications, substitutions, and/or additions may be made, which are within the intended spirit and scope of the disclosure. From the foregoing, it can be seen that the exemplary aspects of the disclosure accomplishes at least all of the intended objectives.

The invention claimed is:

1. A method for permanently discoloring a garment or fabric in order to achieve a desired effect or appearance comprising the steps of applying to an area of the garment or fabric a composition that contains potassium ferrate (VI) in an amount necessary to achieve the desired effect or appearance, and where the area of the garment or fabric acquires a brown shade, wherein the composition does not contain potassium permanganate.

2. The method of claim 1, wherein the garment or fabric is treated with sodium persulfate for about 15 seconds prior to applying the composition.

3. The method of claim 1, wherein the discoloring intensity is controlled by visual inspection by the user based on instantaneous visual feedback.

4. The method of claim 1, wherein the garment is denim or fabric.

5. The method of claim 3, wherein the garment or fabric is indigo-dyed denim, a denim blend, or dyed with dyestuffs.

6. The method of claim 1, wherein the composition is less toxic than potassium permanganate.

7. The method of claim 1, wherein the composition is a dry powder.

8. The method of claim 1, wherein the composition is an aqueous solution.

9. The method of claim 1, wherein the garment is treated to remove metal oxides prior to applying the composition.

10. An improved method for permanent discoloration of fabrics or garments on an industrial-scale that does not use potassium permanganate, comprising applying to an area of the fabric or the garment a composition comprising potassium ferrate (VI) in an amount necessary to achieve a desired effect on the fabric or garment, wherein the composition does not contain potassium permanganate, and where the application onto the area results in the area acquiring a brown shade.

11. The method of claim 10, wherein the composition is an aqueous solution that can be sprayed onto the fabric or garment.

12. The method of claim 10, wherein the composition is less toxic than potassium permanganate.

13. The method of claim 10, wherein the garment is treated with sodium persulfate for about 15 seconds prior to applying the composition.

14. The method of claim 10, wherein the composition is a dry powder.

15. The method of claim 10, wherein the composition is an aqueous solution.

16. The method of claim 10, wherein the garment is treated to remove metal oxides prior to applying the composition.

17. A process for oxidizing a garment or fabric that does not include the use of potassium permanganate, comprising the steps of: applying to the garment or fabric a composition that contains an amount of potassium ferrate (VI) effective to permanently change the original color of the garment or fabric and achieve a desired effect on the garment or fabric, where applying the composition to an area of the garment or fabric results in the area turning a brown shade; and treating the garment or fabric to remove metal oxides, wherein the composition does not contain potassium permanganate.

18. The process of claim 17 wherein the potassium ferrate (VI) is present in an amount ranging from about 10 to 150 g/L.

19. An alternative method to using potassium permanganate in industrial bleaching operations comprising the steps of: applying to a garment a first composition that contains an effective amount of potassium ferrate (VI) to permanently discolor the garment and achieve a desired effect on the garment, where applying the composition to an area of the garment results in the area turning a brown shade, wherein the composition does not contain potassium permanganate, the composition is less hazardous than potassium permanganate, and the application onto the garment results in visual feedback showing the areas where the composition has been applied to the garment; and applying to the garment a second composition that contains an effective amount of oxalic acid to partially or completely remove metal oxide from the garment.

20. The method of claim 19 wherein the first composition is a dry powder that is solubilized in water and then sprayed onto the garment.

21. The method of claim 19 wherein the garment is pre-treated with sodium persulfate prior to applying the first composition to the garment.

* * * * *